US007414215B2

(12) United States Patent
Liu

(10) Patent No.: US 7,414,215 B2
(45) Date of Patent: Aug. 19, 2008

(54) ELASTIC STRIP USED IN ELECTRONIC DEVICE

(75) Inventor: Chin-Sheng Liu, Taipei (TW)

(73) Assignee: Behavior Tech Computer Corp., Taipei (TW)

( * ) Notice: Subject to any disclaimer, the term of this patent is extended or adjusted under 35 U.S.C. 154(b) by 0 days.

(21) Appl. No.: 11/384,454

(22) Filed: Mar. 21, 2006

(65) Prior Publication Data

US 2007/0221489 A1 Sep. 27, 2007

(51) Int. Cl.
*H01H 1/10* (2006.01)

(52) U.S. Cl. ..... 200/517

(58) Field of Classification Search ..... 200/511, 200/512, 341, 520
See application file for complete search history.

(56) References Cited

U.S. PATENT DOCUMENTS 5,819,914 A * 10/1998 Yoneyama ..... 200/344
5,947,616 A * 9/1999 Liang ..... 400/491.2
6,552,282 B2 * 4/2003 Lewis ..... 200/5 A
7,034,239 B2 * 4/2006 Miyako ..... 200/512
7,088,336 B2 * 8/2006 Hsu ..... 345/156
7,119,291 B2 * 10/2006 Sun ..... 200/5 A

* cited by examiner

*Primary Examiner*—Elvin Enad
*Assistant Examiner*—Lheiren Mae A Anglo
(74) *Attorney, Agent, or Firm*—Rosenberg, Klein & Lee

(57) ABSTRACT

The present invention relates to an elastic strip used in electronic devices and designed to enable outlet lines of a membrane circuit board to acquire contact with electrical connections of a printed circuit board through a flat surface. The strip-shaped plate is a strip-shaped structure with an elastic physical property. At least one cavity is disposed in the strip-shaped plate. A rib which corresponds to the cavity is disposed on the upper surface of the strip-shaped plate. Part of the rib protrudes out of the surface of the strip-shaped plate. The rib comprises two rib structures which are connected to the respective sides of the top of the corresponding cavity.

12 Claims, 8 Drawing Sheets

ELASTIC STRIP USED IN ELECTRONIC DEVICE

FIELD OF THE INVENTION

The present invention relates to an elastic strip and more particularly an elastic strip used in a membrane circuit board-based electronic device to press outlet lines of the membrane circuit board against electrical connections of a printed circuit board.

BACKGROUND OF THE INVENTION

A known elastic strip used in a membrane circuit board-based keyboard is disposed beneath outlet lines of the membrane circuit board; with a rebound force produced whenever the known elastic strip is squeezed, the outlet lines of the membrane circuit board are pressed against electrical connections of a printed circuit board, forming electrical connections. There are two types of known elastic strips in terms of structure, namely solid elastic strips and hollow elastic strips. However, when squeezed, both types of the elastic strips produce a rebound force that manifests an enduring linear increment. Referring to FIG. 1 which illustrates a rebound force generated during a squeezing process, while a membrane circuit board is pressed against a printed circuit board by means of a elastic strip. The rebound force generated by the elastic strip varies during the squeezing process; consequently bending curves appear in the outlet lines of the membrane circuit board, aggravated interference with the electrical connections of the electrical connections between the outlet lines and the printed circuit board.

In order to overcome the disadvantage of the prior art, the inventor of the present invention provides an improved elastic strip used in outlet lines of a membrane circuit board to acquire contact with electrical connections of a printed circuit board through a flat surface.

SUMMARY OF THE INVENTION

To approach the above object, the primary object of the present invention provides an elastic strip used in electronic devices and designed to maintain an approximately invariable rebound force when squeezed to a predetermined extent, to enable outlet lines of a membrane circuit board to acquire contact with electrical connections of a printed circuit board through a flat surface.

The present invention is to provide an elastic strip used in electronic devices, comprising a strip-shaped plate with an elastic physical property, at least one cavity disposed in the strip-shaped plate, and a rib disposed on the upper surface of the strip-shaped plate and aligned with the corresponding cavity. The rib comprising two rib structures connected to the respective sides of the top of the hollowed cavity. In addition, partially rib structures protrude out the surface of the strip-shaped plate.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
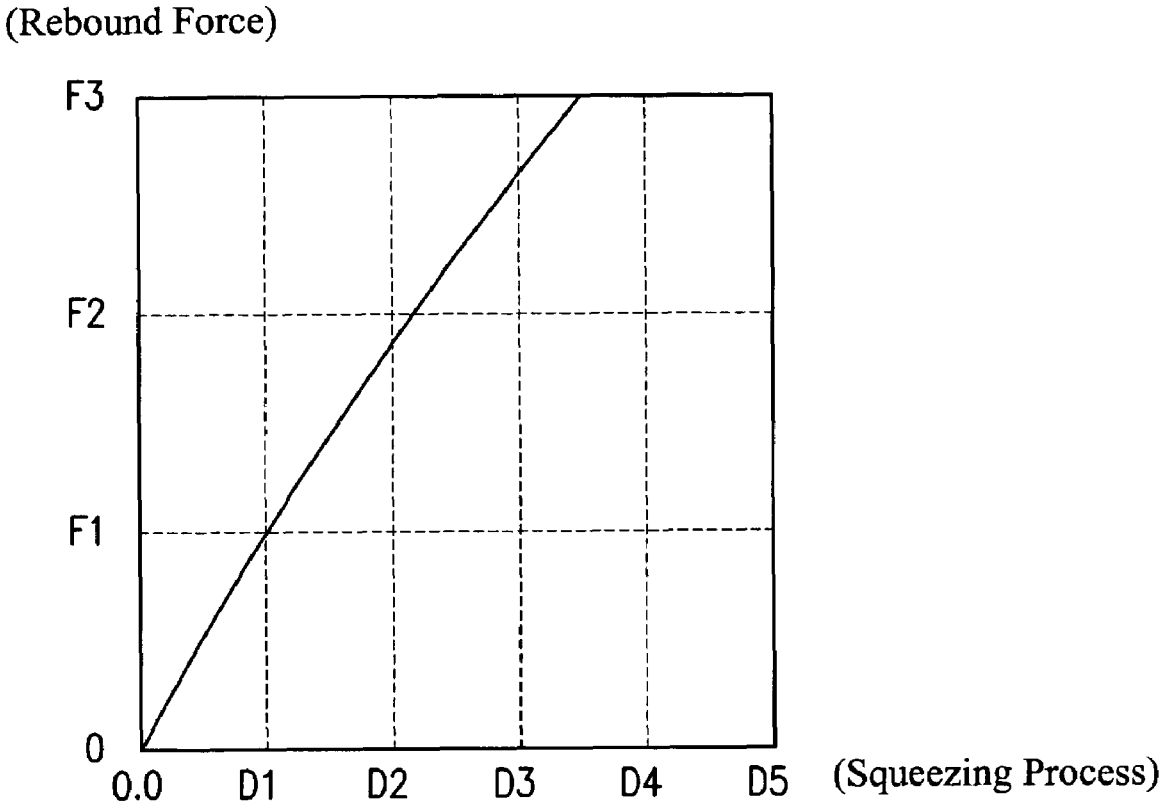
FIG. 1 (PRIOR ART)
FIG. 1 illustrates a rebound force generated during a squeezing process while a membrane circuit board is pressed against a printed circuit board by means of a known elastic strip used in electronic devices.
Figure 2:
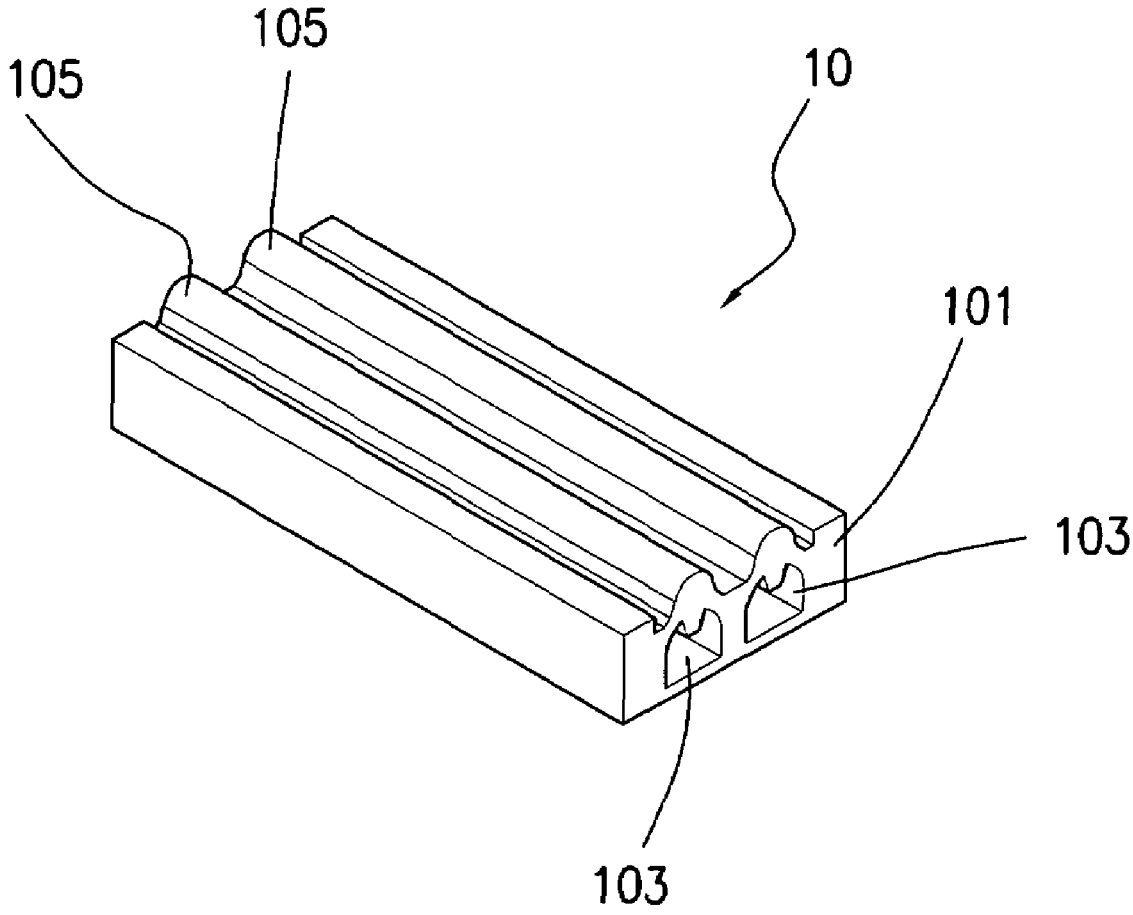
FIG. 2 is an elevational view of the elastic strip used in electronic devices of the present invention.
Figure 3:
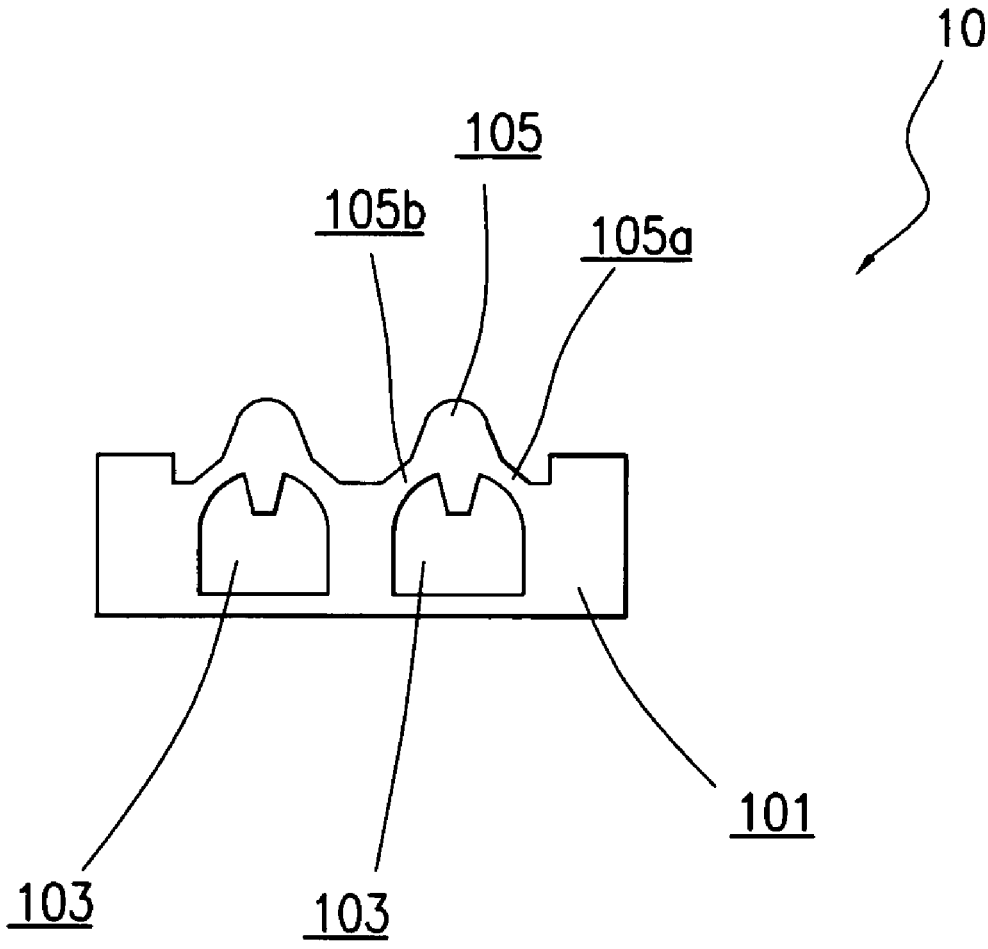
FIG. 3 is a cross section view of the elastic strip of FIG. 2 of the present invention.
Figure 4:
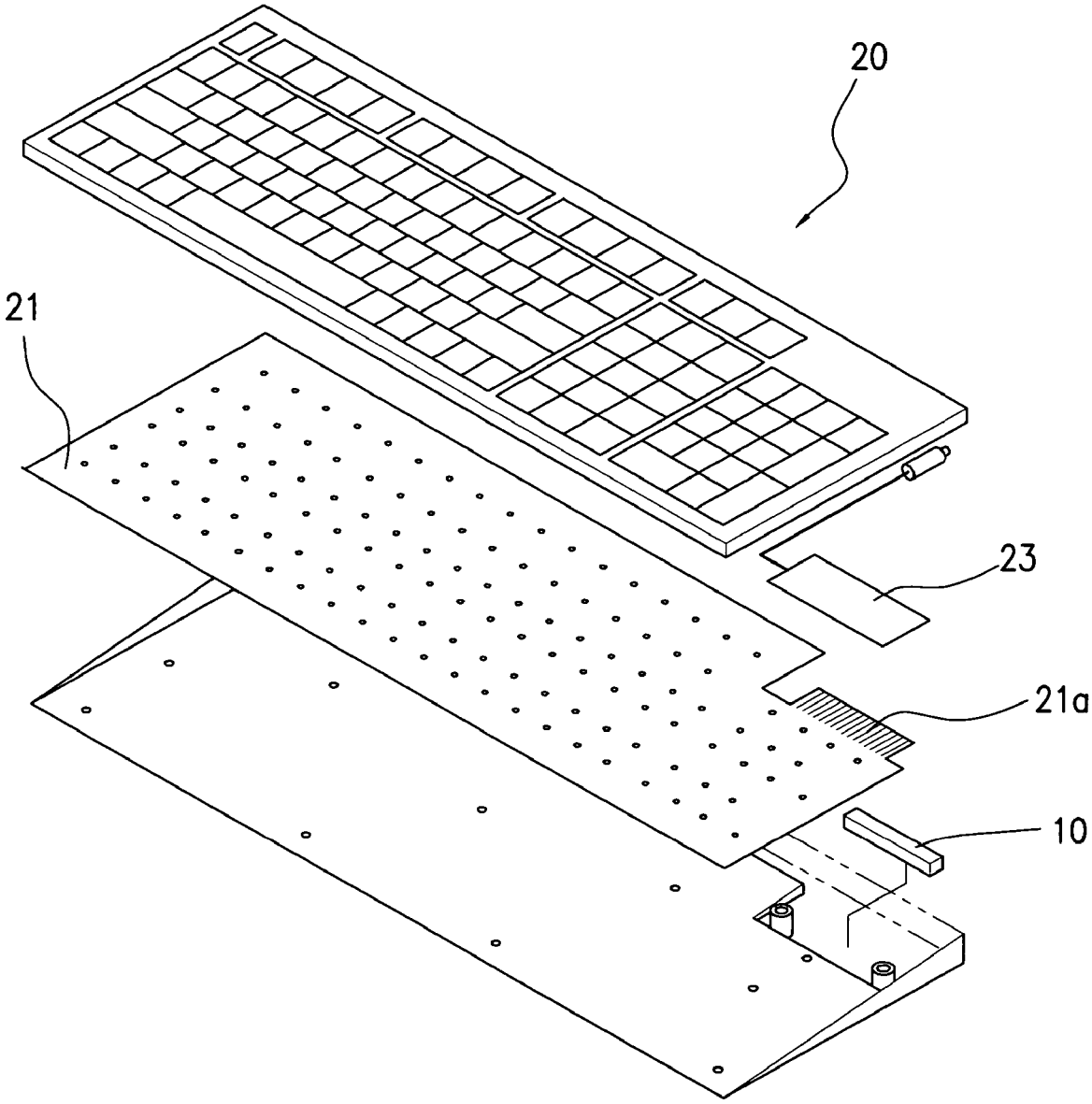
FIG. 4 is an exploded view of the elastic strip applied to an electronic device equipped with a membrane circuit board of the present invention.

In the present invention, FIG. 2 is a elevational view of an elastic strip used in an electronic device, FIG. 3 shows a cross-sectional view of the elastic strip of FIG. 2, and FIG. 4 shows an exploded view of the elastic strip applied to an electronic device equipped with a membrane circuit board. An elastic strip 10 used in an electronic device 20 comprises a strip-shaped plate 101, at least one cavity 103, and at least a rib 105. The strip-shaped plate 101 is a strip-shaped structure with an elastic physical property and a rectangular transverse cross-section. The cavity 103 is disposed inside the strip-shaped plate 101 which is a closed hollow strip-shaped structure. The rib 105 is disposed on the upper surface of the strip-shaped plate 101. Partially rib 105 protrudes out of the upper surface of the strip-shaped plate 101 and touches a membrane circuit board 21. The rib 105 comprises two rib structures 105*a* and 105*b* which are connected to the respective sides of the top of the corresponding cavity 103. Overall, the cross section view of rib 105 is a Λ-shaped structure.

It is allowable to dispose two or more cavities 103, aligned in a row, spaced at predetermined intervals, and installed inside the strip-shaped plate 101. The top of each cavity 103 is connected to a corresponding rib 105.

As shown in FIG. 4, an embodiment of the electronic device 20 is a membrane circuit board-based keyboard, wherein a printed circuit board 23 is disposed above the membrane circuit board 21, whereas the elastic strip 10 is disposed beneath the membrane circuit board 21. The assembly of the electronic device 20 includes pressing and connecting the printed circuit board 23, the membrane circuit board 21 and the elastic strip 10, which are positioned relative to each other from the top to the bottom, so that they keep being a tight squeeze; as a result, outlet lines 21*a* of the membrane circuit board 21 touches electrical connections of the printed circuit board 23 (not shown), forming electrical connections.

Figure 5:
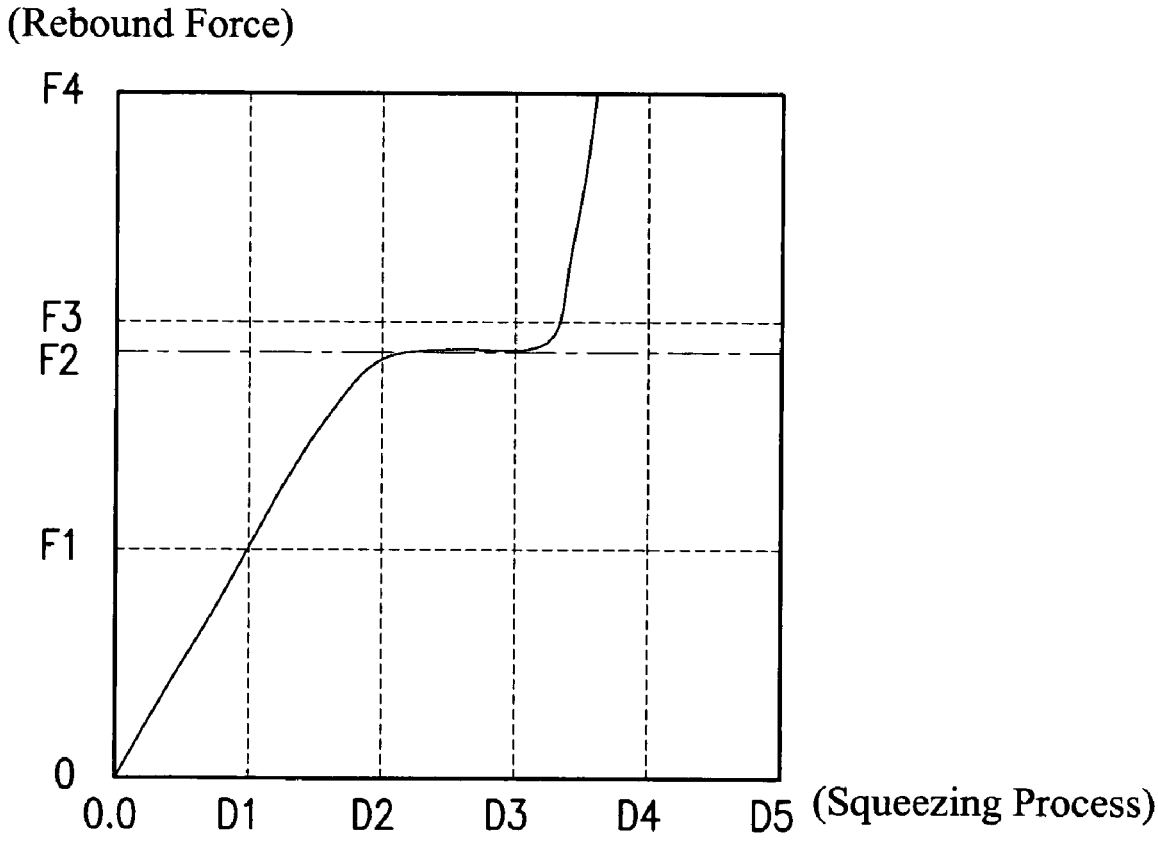
FIG. 5 illustrates a rebound force generated during a squeezing process while a membrane circuit board is pressed against a printed circuit board by means of the elastic strip of the present invention.

FIG. 5 illustrates a rebound force generated during a squeezing process wherein a membrane circuit board is pressed against a printed circuit board by means of the elastic strip of the present invention. The elastic strip 10 of the present invention maintains a quite consistent rebound force F2 when squeezed to an allowable extent, the squeezing process D2 through D3 as shown in FIG. 5, and thereby enables the outlet lines 21*a* of the membrane circuit board 21 to touch electrical connections of the printed circuit board 23 through a flat surface and prevents bends which may otherwise form whenever an inconsistent rebound force is generated because of the squeezing of the outlet lines 21*a* of the membrane circuit board 21.

Figure 6:
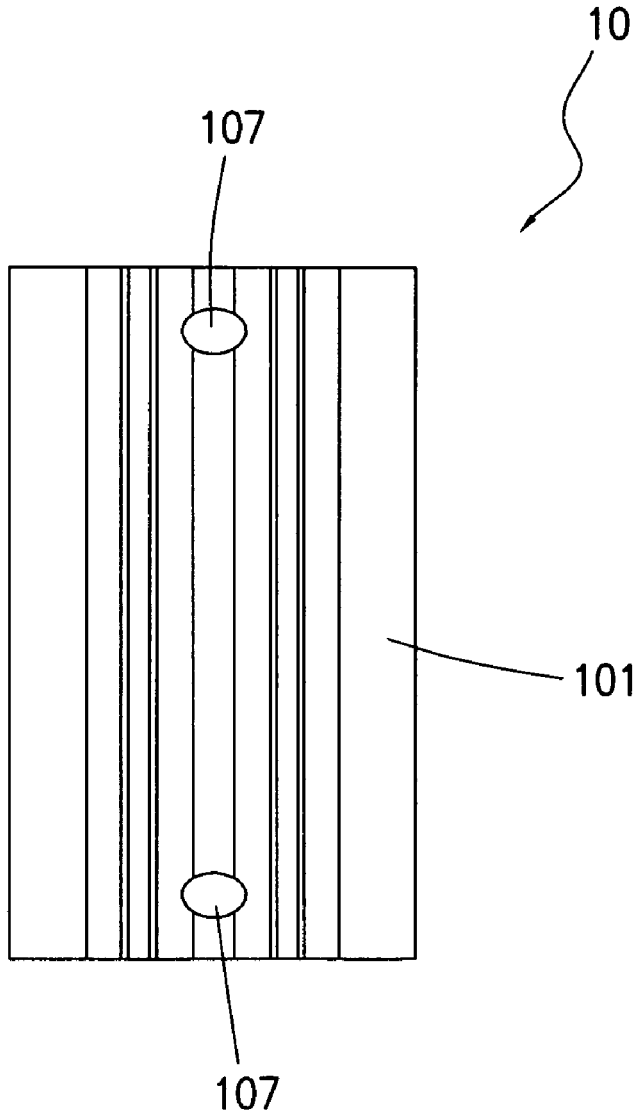
FIG. 6 is a plan view of through holes of the elastic strip of the present invention.

FIG. 6 is a plan view of through holes of the elastic strip of the present invention. Further disposed in the elastic strip 10 of the present invention are through holes 107 that penetrate the strip-shaped plate 101 and primarily serve as passages for joint elements (not shown) of which the embodiment are screws; the screws penetrate the printed circuit board 23 and then the through holes 107 before being screwed to the base of the electronic device 20.

Figure 7:
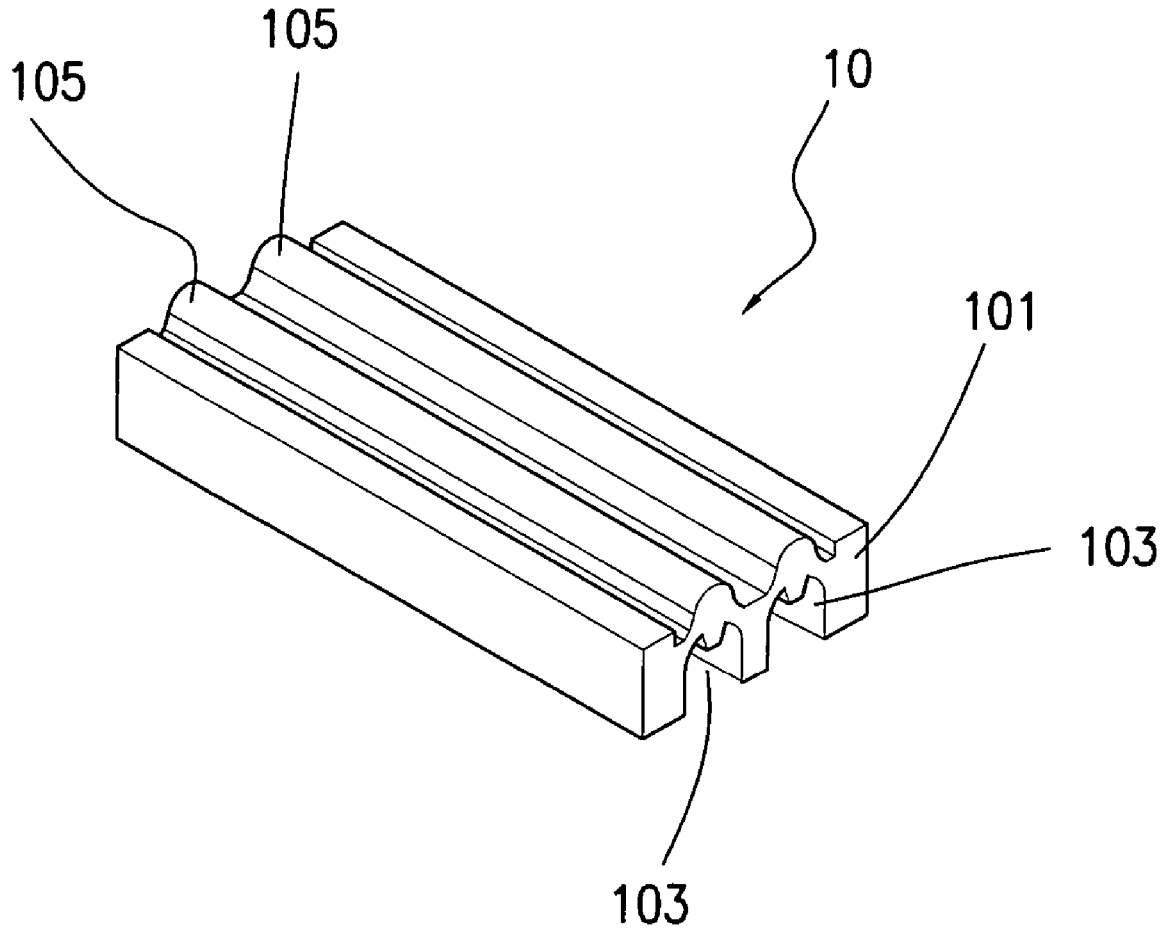
FIG. 7 is an elevational view of another embodiment of the elastic strip used in electronic devices of the present invention.
Figure 8:
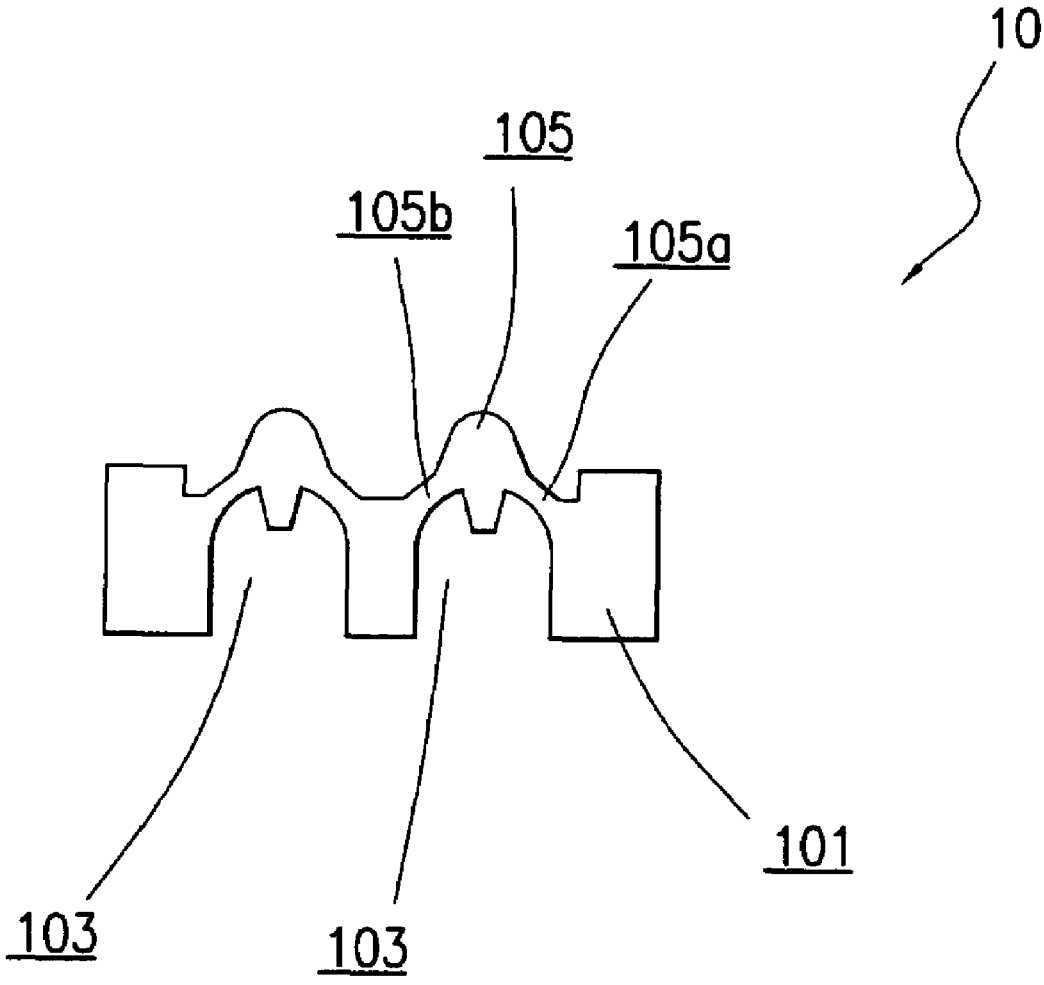
FIG. 8 is a cross section view of the elastic strip of FIG. 7.

FIG. 7 shows an elevational view of another embodiment of the elastic strip used in electronic devices of the present invention, whereas FIG. 8 shows a cross-sectional view of the elastic strip of FIG. 7 of the present invention. As shown in FIG. 7, the cavities 103 of the elastic strip 10 appear in the form of strip-shaped grooves and are disposed on the lower surface of the plate 101.

As regards the elastic strip of the present invention, its rebound force remains consistent whenever it is squeezed to an allowable extent; the advantage makes the elastic strip of the present invention superior than the prior elastic strips. Besides, with the elastic strip of the present invention, outlet lines of a membrane circuit board touch electrical connections of a printed circuit board through a flat surface, contributing to a marked improvement.

While the present invention has been described by way of examples and in terms of a preferred embodiment, it is to be understood that the present invention is not limited thereto. It should be understood that the detailed description and specific examples, while indicating preferred embodiments of the present invention, are given by way of illustration only, since various changes and modifications within the spirit and scope of the present invention will become apparent to those skilled in the art from this detailed description. Therefore the scope of the appended claims should be accorded the broadest interpretation so as to encompass all such changes and modifications.

What is claimed is:

1. An elastic strip used in electronic devices, comprising:

a longitudinally extending elastic strip-shaped plate;

at least two longitudinally extending cavities formed on a bottom portion of said elastic strip-shaped plate, said cavities being aligned in a row and transversely displaced each from the other;

a pair of rib members forming an upper portion of said elastic strip-shaped plate that corresponds and are vertically aligned with each said cavity, wherein each of said ribs is disposed on an upper surface of said strip-shaped plate and said ribs partially protrude externally above said upper surface.

2. The elastic strip as in claim 1, wherein a cross-section of said rib has an Λ-shape cross-sectional contour.

3. The elastic strip as in claim 1, further comprising a through hole, wherein said through hole penetrates said strip-shaped plate.

4. An elastic strip used in electronic devices, comprising:

a strip-shaped plate with an elastic physical property;

at least one cavity formed on an bottom surface of said strip-shaped plate; and a rib that corresponds to said cavity, wherein said rib is located on an upper surface of said strip-shaped plate and said rib partially externally protrudes from said upper surface in substantially vertical alignment with said at least one cavity, said rib having an Λ-shaped cross-sectional contour.

5. The elastic strip as in claim 4, wherein said cavities are aligned in a row and spaced at intervals.

6. The elastic strip as in claim 4, further comprising a through hole, wherein said through hole penetrates said strip-shaped plate.

7. An elastic strip used in electronic devices, comprising:

a longitudinally extending elastic strip-shaped plate, said strip-shaped plate having a vertically extending through hole penetrating said strip-shaped plate;

at least one cavity having substantially planar opposing sidewalls disposed in said strip-shaped plate; and a rib that corresponds to said cavity, wherein said rib is disposed on an upper surface of said strip-shaped plate and said rib partially protrudes from said upper surface in substantial vertical alignment with said at least one cavity, said rib having an Λ-shaped cross-sectional contour.

8. The elastic strip as in claim 1, 4 or 7, wherein each said rib comprises rib structures connected to a top of a corresponding one of said cavities.

9. The elastic strip as in claim 8, wherein said rib structures are connected to respective sides of the top of said corresponding cavity.

10. The elastic strip as in claim 1, 4 or 7, wherein said cavity is a hollowed stripe-shaped structure disposed inside of said strip-shaped plate.

11. The elastic strip as in claim 1, 4 or 7, wherein said cavity is a stripe-shaped groove disposed on the lower surface of said strip-shaped plate.

12. The elastic strip as in claim 7, wherein said cavities are aligned in a row and spaced at intervals.

* * * * *